US008030562B2

(12) United States Patent
Janney et al.

(10) Patent No.: US 8,030,562 B2
(45) Date of Patent: Oct. 4, 2011

(54) AROMA DRUMHEAD

(75) Inventors: Alyssa Swiney Janney, Saugus, CA (US); Louis Charles Cavallaro, Jr., Valencia, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 12/461,879

(22) Filed: Aug. 25, 2009

(65) Prior Publication Data

US 2011/0048212 A1 Mar. 3, 2011

(51) Int. Cl.
*G10D 13/02* (2006.01)

(52) U.S. Cl. ..... 84/411 R

(58) Field of Classification Search ..... 84/411 R; 446/297, 188, 408, 418
See application file for complete search history.

(56) References Cited

U.S. PATENT DOCUMENTS 4,346,059 A 8/1982 Spector
4,544,592 A 10/1985 Spector
4,556,539 A 12/1985 Spector
4,629,604 A 12/1986 Spector
4,728,212 A 3/1988 Spector
4,967,632 A * 11/1990 Etheredge et al. ..... 84/385 P
7,135,630 B2 * 11/2006 Maruhashi et al. ..... 84/411 P
7,354,667 B1 * 4/2008 Knapp ..... 424/443
2002/0153007 A1 10/2002 Davi

* cited by examiner

*Primary Examiner* — Kimberly Lockett
(74) *Attorney, Agent, or Firm* — Beaumont Gitlin Tashjian; Larry F. Gitlin

(57) ABSTRACT

A musical drumhead having a top surface and bottom surface and a means attached to the drumhead for discharging an aromatic vapor. The musical drumhead is comprised of a membrane having means to vent the aromatic vapors through the top surface of the drumhead and disperse the vapors into the surrounding environment. Vent means comprises a plurality of vent holes in the drumhead membrane through which the vapors are discharged. The primary source of the vapors is a pad of porous material impregnated with an aroma producing liquid with a pleasing fragrance. The pad of porous material is attached in some conventional manner to the bottom surface of the drumhead immediately beneath the vent holes. The striking of the drumhead produces a vibration in the drumhead membrane which, in turn, excites the molecules in the air beneath and above the membrane. The aromatic oil vapors gathered around the impregnated pad are initially forced in all directions by the excited air and then dispersed through the vent holes into the surrounding areas.

5 Claims, 7 Drawing Sheets

AROMA DRUMHEAD

BACKGROUND OF THE INVENTION

1. Field of the Invention

The present invention relates generally to the area of musical drumhead construction and, more particularly, to a musical drumhead having a means to discharge a pleasing aromatic vapor when struck and made to vibrate.

2. Description of the Prior Art

Musical drumheads of all sizes and shapes and constructed of a variety of materials, including natural skins and synthetics, are well-known in the prior art. Also well-known in the prior art are musical drumheads that are combined with a variety of articles in order to vary the tone or sounds emanating from the instrument, or other kinds of materials that, when combined with the drumhead, produce a pleasing appearance, such as, for example, designs containing a variety of colors and geometric shapes. Musical drumheads also come in various thicknesses and, in certain instances, may even contain an opening for air to pass through to alter the sound of the drum.

Unknown in the prior art, though, is the use of any type of means for discharging an aromatic vapor in combination with the play of a musical drumhead. Specifically, conspicuously absent in the prior art are musical drumheads that contain some sort of device which, when attached to either the top or the bottom surface of a drumhead, serves to discharge an aromatic vapor when the drumhead is struck by any type of hard object, such as, for example, a drumstick. More specifically, the vibrations in the membrane caused by the striking of the head with a hard object first excites the air above and below the drumhead membrane and around the device itself. Then, the excited air forces the aromatic vapors in all directions An example of this device is a felt pad impregnated with an aromatic liquid and surrounded by aromatic vapors produced by the liquid in the pad.

The present invention is a improvement over the prior art in that it employs a means attached to a musical drumhead for discharging a pleasing aromatic vapor including, in the preferred embodiment of the present invention, a musical drumhead with a plurality of vent holes through which the aromatic vapors are discharged into the air forced there by excited air produced by the vibrations that result when the drumhead membrane is struck.

SUMMARY OF THE INVENTION

The present invention provides for a musical drumhead having a top surface and bottom surface and a means attached to the drumhead for discharging an aromatic vapor. In the preferred embodiment of the invention, the musical drumhead is comprised of a membrane having means to vent the aromatic vapors through the top surface of the drumhead and disperse the vapors into the surrounding environment. Such means comprises a plurality of vent holes through which the vapors are discharged. The primary source of the vapors is a pad of porous material impregnated with an aroma producing liquid, including a pleasing fragrance. The pad of porous material is attached in some conventional manner to the bottom surface of the drumhead immediately beneath the vent holes. The striking of the drumhead first produces a vibration in the membrane which, in turn, excites the air beneath and above the membrane. The aromatic oil vapors gathered around the impregnated pad are first forced in all directions and then dispersed through the vent holes into the surrounding areas.

Accordingly, an object of the present invention is to provide a musical drumhead having a means attached to the drumhead for discharging a pleasing aromatic vapor.

Another object of the present invention is to provide a musical drumhead containing a plurality of vent holes through which the aromatic vapors are discharged.

Still another object of the present invention is to provide a musical drumhead with a pad of porous material impregnated with an aroma producing liquid as the source of the aromatic vapor.

Still yet another object of the present invention is to provide a musical drumhead which has the means to discharge an aromatic vapor upon the striking of the drumhead membrane.

Still yet another object of the present invention is to provide a musical drumhead which, upon being struck by a hard object, is made to vibrate, whereupon the vibrations excite the air immediately beneath and above the drumhead membrane, forcing the dispersal of the vapors in all directions.

Still yet another object of the present invention is to provide a musical drumhead with the means for discharging the aromatic vapors positioned beneath vent holes in the drumhead membrane.

Still yet another object of the present invention is to provide a musical drumhead with means to discharge aromatic vapors that can be easily and efficiently manufactured.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
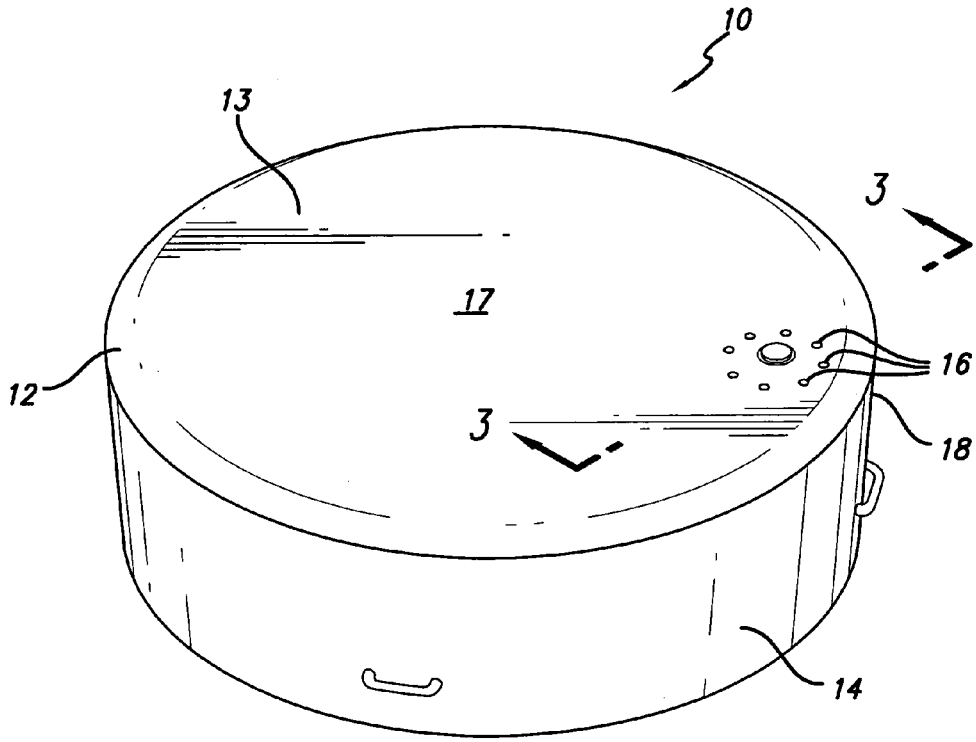
FIG. 1 is a perspective view of a drumhead constructed in accordance with the present invention.
Figure 2:
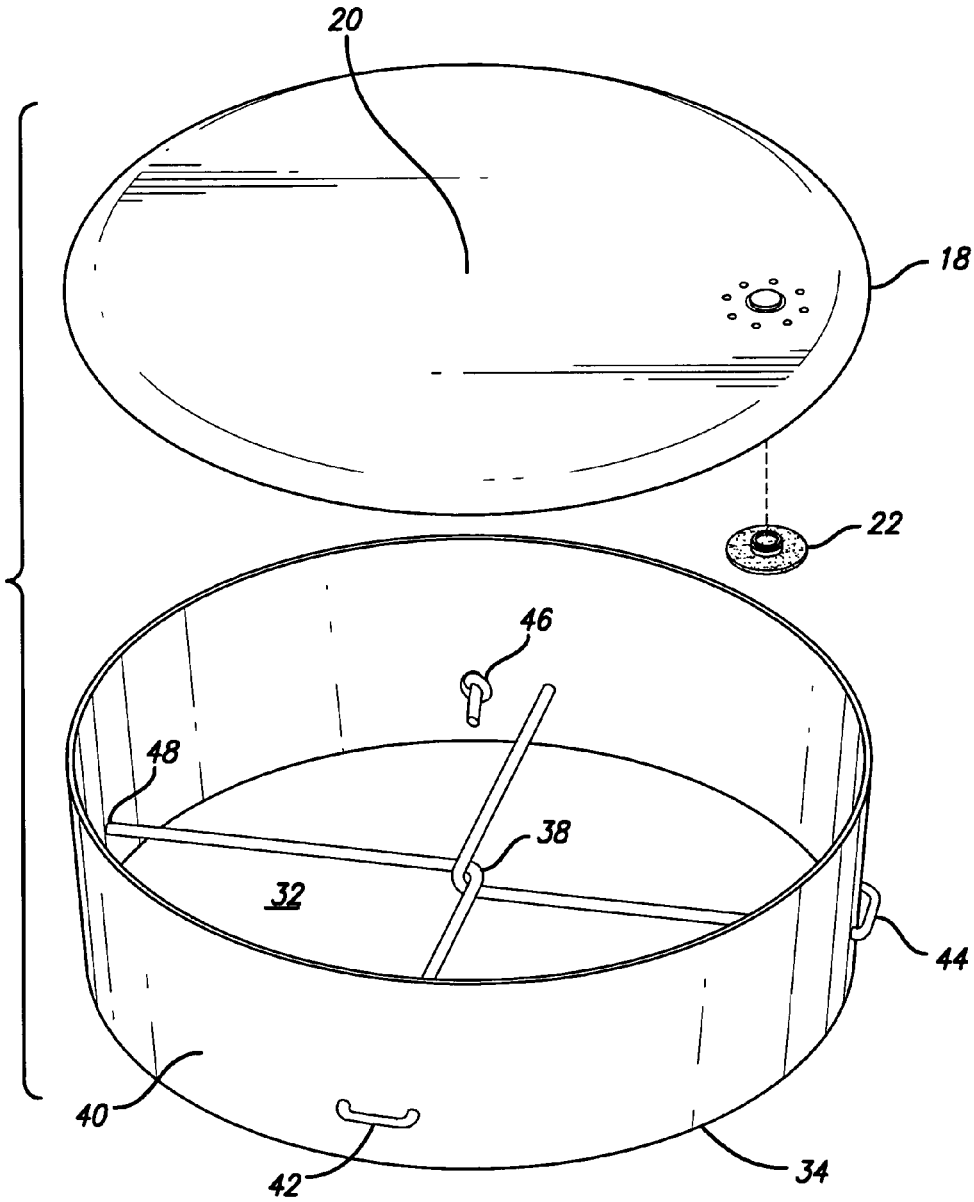
FIG. 2 is an exploded view of a drumhead constructed in accordance with the present invention.

FIG. 1 depicts a perspective view of the preferred embodiment of the present invention comprising a drum designated generally as 10. Drum 10 includes a drumhead 12 having a top surface 13 and a bottom surface 15, and a drum shell 14. Drumhead 12 is comprised of drumhead membrane 17 and may be attached to the drumshell 14 using any one of several conventional methods, all well known in the prior art. Drumhead 12 may be pre-tuned (pre-tensioned) or tunable. Drumhead 12 contains one or more vent holes 16 formed usually near edge 18 of drumhead membrane 17 to permit a drummer unfettered access to the central portion 20 of drumhead 12 for striking the instrument. Attached to bottom surface 15 of drumhead 12 immediately below vent holes 16 is a pad of porous material 22 secured to drumhead 12, preferably with snap coupling 24 consisting of snap components 26 and 28. Other kinds of fasteners not shown here may also be suitable. Pad 22, which is impregnated with aromatic oil 30, is fastened into position beneath vent holes 16 approximately ½" below bottom surface 15. Lesser or greater separation between pad 22 and bottom surface 15 may also be appropriate depending upon a variety of factors.

Drum 10 may be held by inserting a hand (not shown) inside bottom opening 32 of drumshell 14 and grasping bottom edge 34. Holding drum 10 at any appropriate angle, the drummer using drumstick 36 may then strike drumhead 12 to produce a musical sound. Another handle option is rope handle 38 looped at the center inside drumshell 14 and secured along sidewall 40 of drumshell 14 at locations 42, 44, 46 and 48. Rope handle 38 enables drumhead 12 to be held so that drumhead membrane 17 may vibrate freely and sustain the drum sounds longer.

Figure 3A:
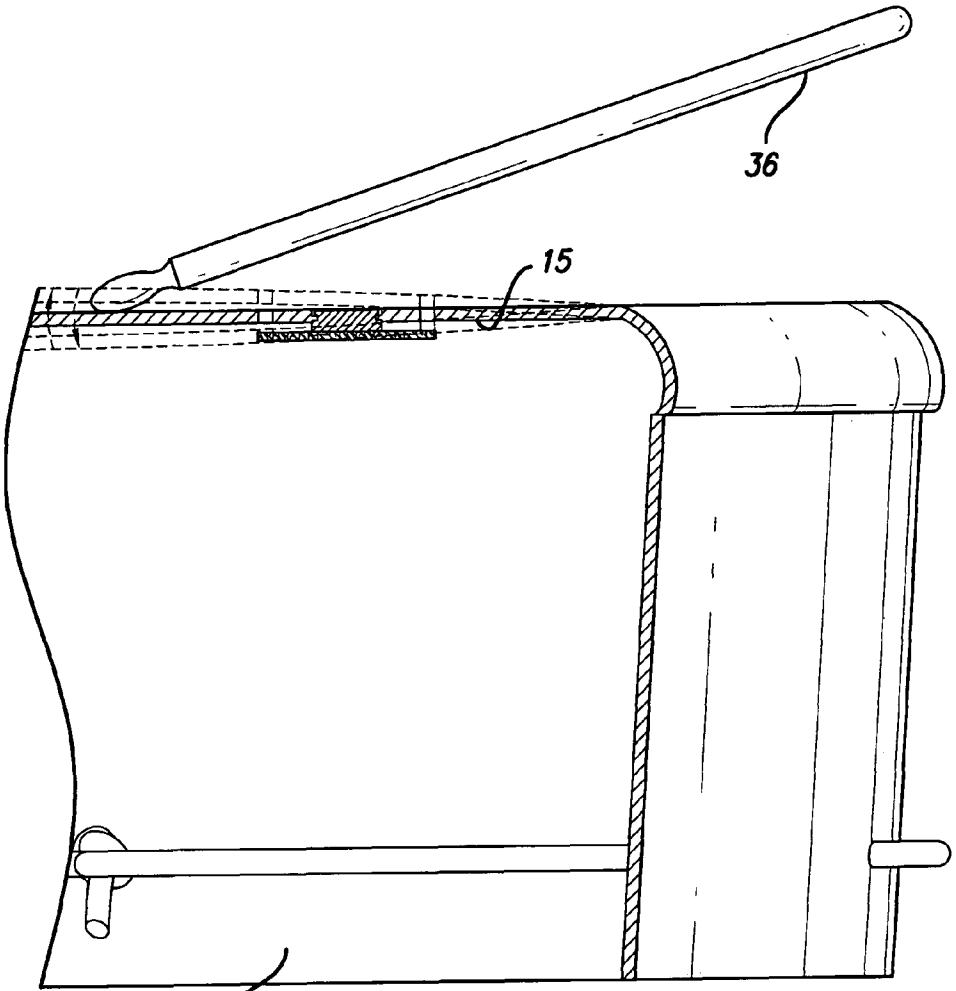
FIG. 3A is an cross-sectional view of the drumhead constructed in accordance with the present invention taken along line 3-3 of FIG. 1.
Figure 3B:
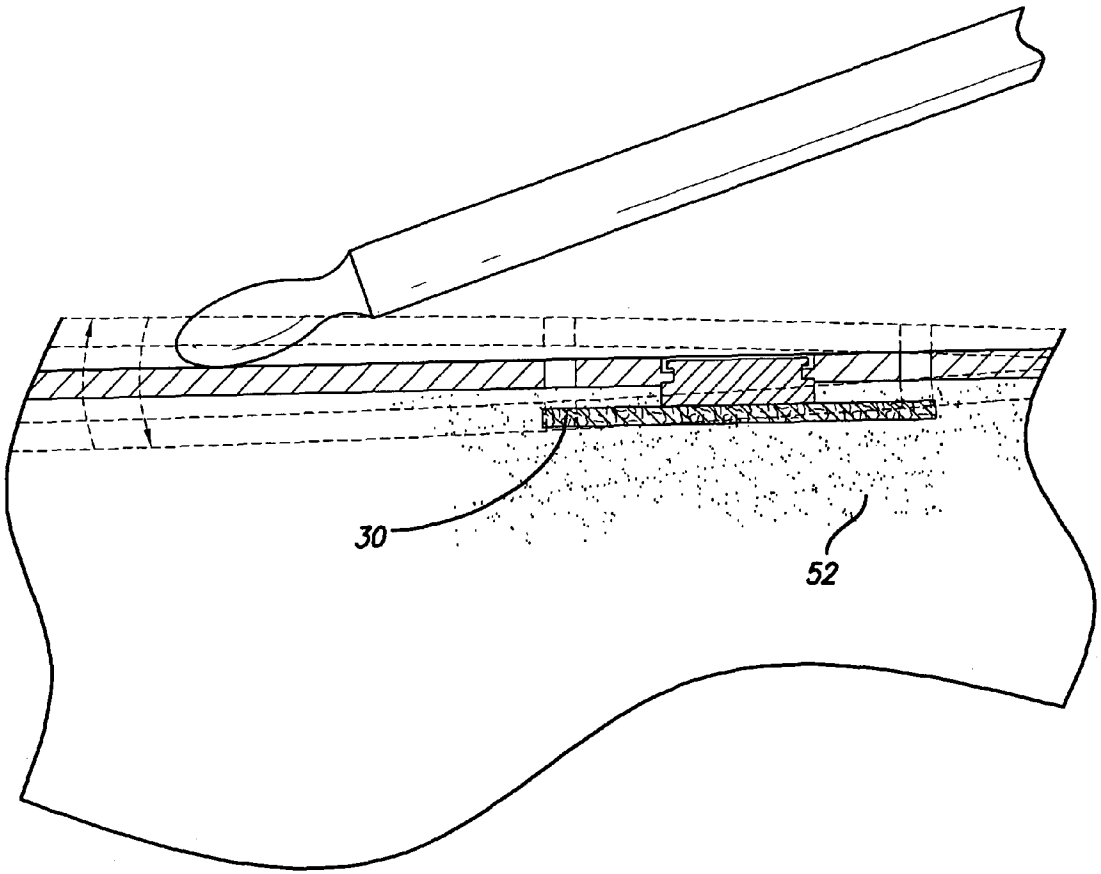
FIG. 3B is an cross-sectional view of the drumhead constructed in accordance with the present invention taken along line 3-3 of FIG. 1.
Figure 3C:
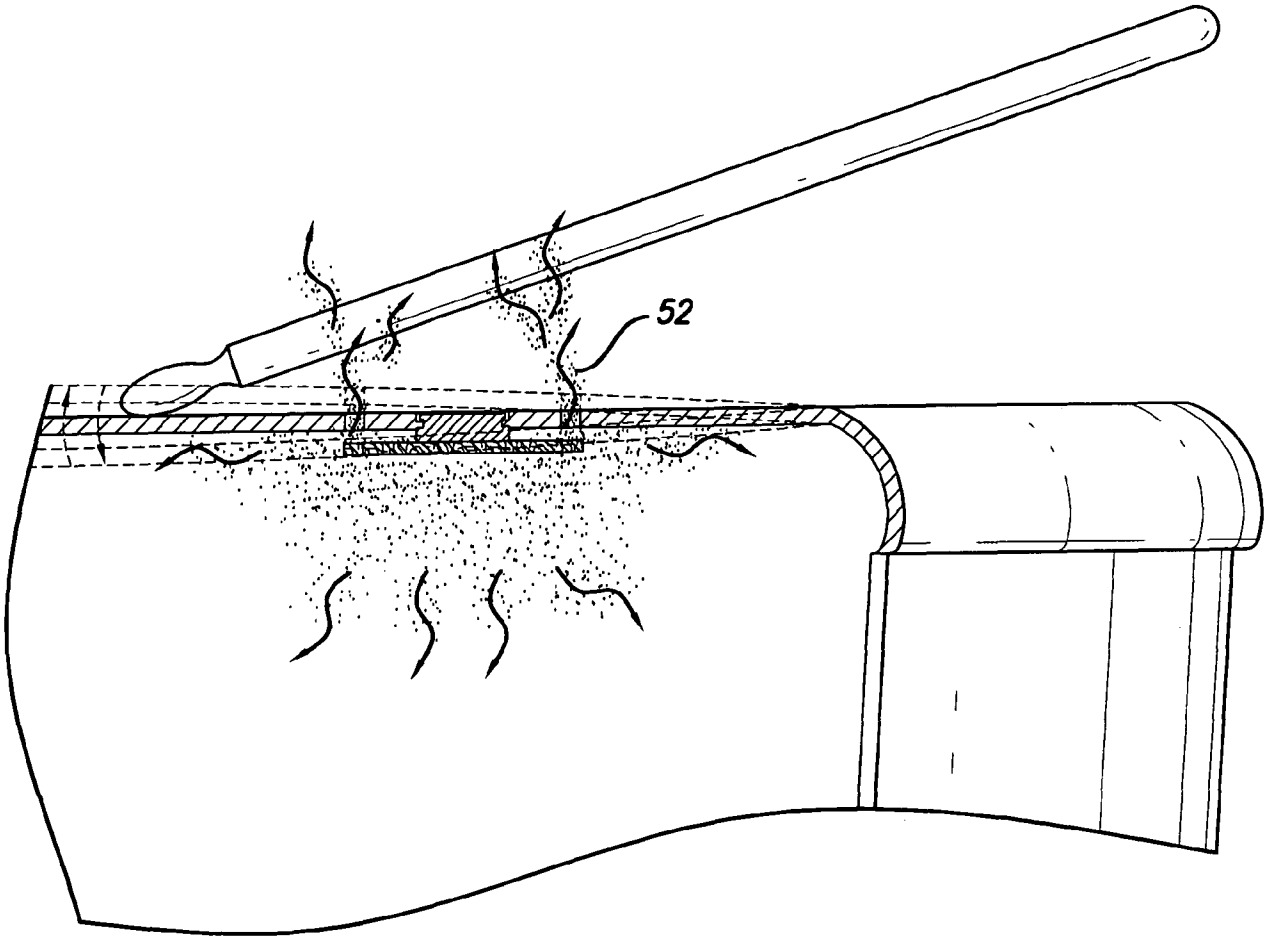
FIG. 3C is an cross-sectional view of the drumhead constructed in accordance with the present invention taken along line 3-3 of FIG. 1.
Figure 4:
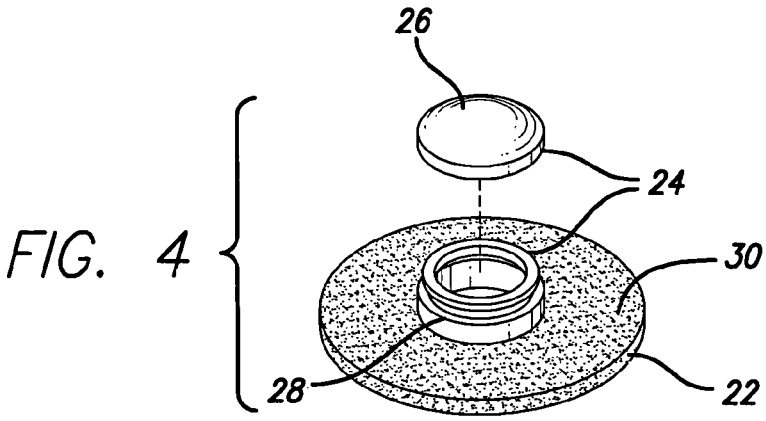
FIG. 4 is an exploded view of the coupling components shown incorporated with the pad of porous material containing an aromatic liquid, the combination constructed in accordance with the present invention.
Figure 5:
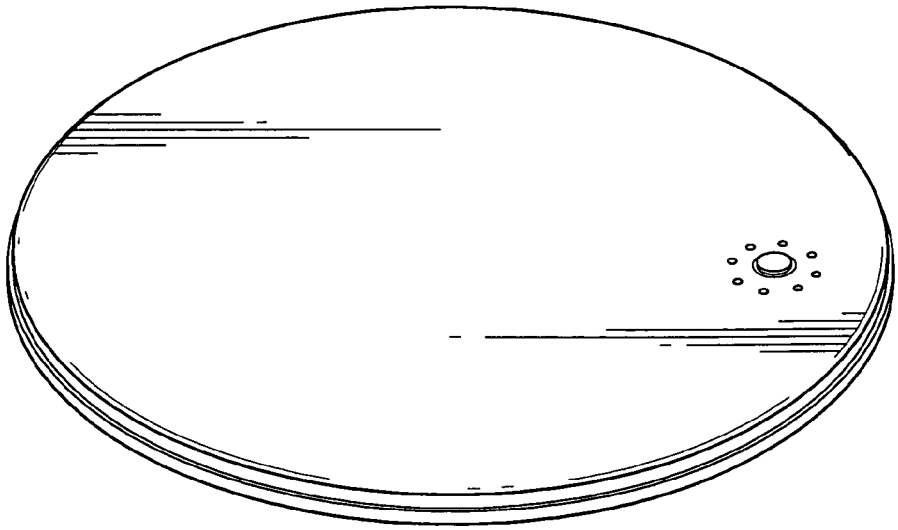
FIG. 5 is a perspective view of an alternative embodiment of a drumhead constructed in accordance with the present invention.
Figure 6:
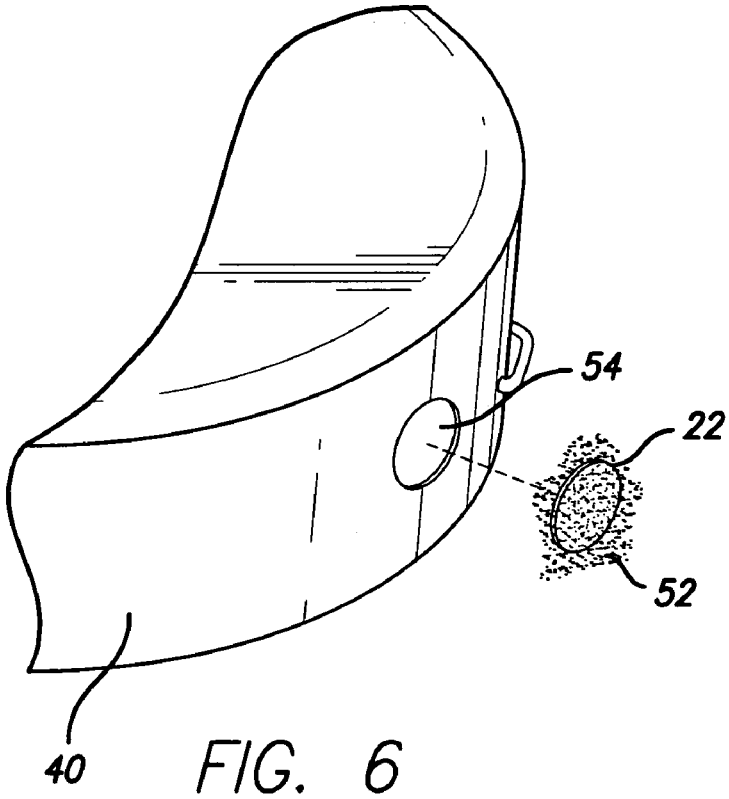
FIG. 6 is a perspective view of another alternative embodiment of a fragmented section of a drumhead constructed in accordance with the present invention.
Figure 7:
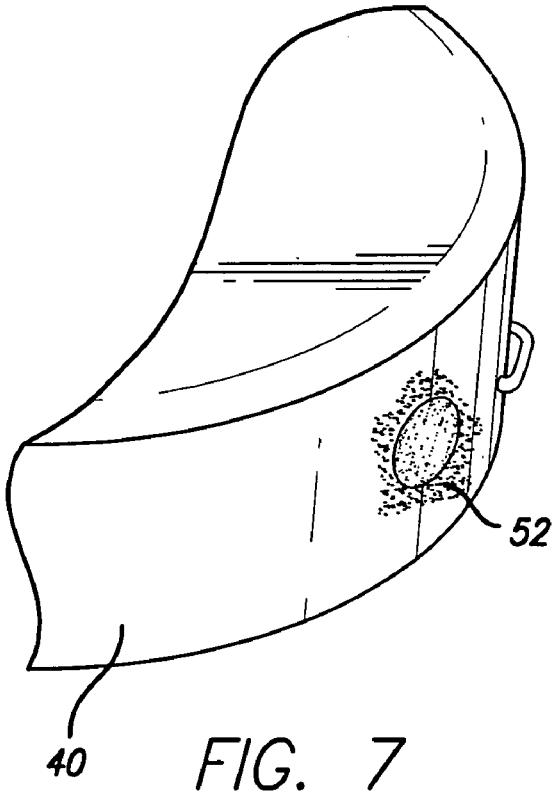
FIG. 7 is a perspective view of the alternative embodiment of the fragmented section of the drumhead constructed in accordance with the present invention shown in FIG. 6.

In a typical application of the present invention, drumstick 36 is used to strike drumhead 12 (a mallet or hand may also be used), usually somewhere on or near central portion 20 to cause head 12 to produce vibrations (see FIGS. 3A, 3B and 3C). These vibrations, in turn, excite air molecules (not shown) that surround pad 22, which, in turn, force aromatic vapors 52 in every direction, including within drumshell 14 and out through the open bottom, and upwardly through vent holes 16 into the atmosphere, producing a pleasant scent throughout. The result is both a pleasing sound and aroma as the instrument is being played.

In an alternative embodiment of the present invention, opening 54 is formed within sidewall 40 and the aromatic liquid impregnated porous pad 22 is placed therein, where pad 22 is secured. When drumhead 12 is struck by a hard object, the drumhead membrane vibrates, exciting the air molecules (not shown) on either side of pad 22. The excited air molecules then force aromatic vapors 52, which are hovering about either side of pad 22, to disperse.

Another alternative embodiment (not shown) of the present invention involves the use of some sort of conventional bracket, which is attached to the drumshell and supports the pad either horizontally below the drumhead or vertically just inside the drumshell where the opening is formed.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. A drumhead for a musical drum comprising:

a drumhead having a membrane with a top surface and a bottom surface; and, a means for discharging an aromatic vapor spatially separated from and below said bottom surface of said drumhead membrane wherein said aromatic vapor is discharged into the atmosphere upon the striking of said drumhead membrane with a hard object.

2. A drumhead for a musical drum comprising:

a drumhead having a membrane with a top surface and a bottom surface, said membrane having a plurality of vent holes and a pad of porous material impregnated with an aroma-producing liquid for discharging an aromatic vapor, said pad of porous material being attached to said bottom surface of said drumhead membrane adjacent to said vent holes with a snap connection comprising a male coupling member and a female coupling member.

3. A musical drum comprising:

a drumhead having a membrane with a top surface and a bottom surface;

a drumshell attached to said drumhead, said drumshell having a continuous sidewall, said sidewall having an opening; and, a pad of porous material impregnated with an aromatic oil liquid, said pad being positioned inside said opening and attached to said sidewall.

4. The musical drum of claim 3 wherein said aromatic vapors are discharged into the atmosphere upon the striking of said drumhead membrane with a hard object.

5. The musical drum of claim 4 wherein said struck drumhead membrane imparts vibrational energy to the air above and beneath said drumhead membrane, said vibrational energy acting to excite said air in all directions to disperse said aromatic vapors.

* * * * *